US010879651B2

(12) United States Patent
Laurx et al.

(10) Patent No.: US 10,879,651 B2
(45) Date of Patent: Dec. 29, 2020

(54) SELECTIVELY SHIELDED CONNECTOR CHANNEL

(71) Applicant: Molex, LLC, Lisle, IL (US)

(72) Inventors: John Laurx, Aurora, IL (US); Chien-Lin Wang, Naperville, IL (US); Vivek Shah, Buffalo Grove, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/081,541

(22) PCT Filed: Jun. 16, 2017

(86) PCT No.: PCT/US2017/037918
§ 371 (c)(1),
(2) Date: Aug. 31, 2018

(87) PCT Pub. No.: WO2017/218919
PCT Pub. Date: Dec. 21, 2017

(65) Prior Publication Data

US 2020/0119498 A1 Apr. 16, 2020

Related U.S. Application Data

(60) Provisional application No. 62/363,635, filed on Jul. 18, 2016.

(51) Int. Cl.
*H01R 13/6587* (2011.01)
*H01R 13/6591* (2011.01)

(52) U.S. Cl.
CPC ..... *H01R 13/6587* (2013.01); *H01R 13/6591* (2013.01)

(58) Field of Classification Search
CPC ..... H01R 13/648
(Continued)

(56) References Cited

U.S. PATENT DOCUMENTS 6,776,659 B1 * 8/2004 Stokoe ..... H01R 13/6473 439/607.11
7,371,117 B2 * 5/2008 Gailus ..... H01R 13/719 439/607.08

(Continued)

FOREIGN PATENT DOCUMENTS

CN 103296538 A 9/2013
CN 203242846 U 10/2013

(Continued)

OTHER PUBLICATIONS

Office action received for KR patent application No. 10-2018-7030234, dated Jul. 16, 2019, 13 pages. (6 pages of English translation and 7 pages of official copy).

(Continued)

*Primary Examiner* — Alexander Gilman

(57) ABSTRACT

A connector system includes a wafer that has a shield that replaces standard ground terminals and an additional isolation shield to provide enhanced electrical isolation. To further improve electrical performance, transmit and receive channels can be provided in separate wafers on one side of connector system with a space or wafer between the transmit and signal wafers. On the other side of the connector system the wafer will have one or two spaces that are either black or filled with terminals that operate at lower frequencies. A conductive insert can provide further isolation intra-wafer.

9 Claims, 17 Drawing Sheets

(58) Field of Classification Search
USPC ..... 439/607.07
See application file for complete search history.

(56) References Cited

U.S. PATENT DOCUMENTS

| | | | | |
|---|---|---|---|---|
| 8,690,604 | B2 * | 4/2014 | Davis | H01R 12/00 439/607.07 |
| 8,961,229 | B2 * | 2/2015 | Pan | H01R 13/6474 439/607.07 |
| 8,992,252 | B2 * | 3/2015 | McClellan | H01R 13/6587 439/607.05 |
| 9,004,942 | B2 * | 4/2015 | Paniagua | H01R 13/6581 439/607.07 |
| 9,093,800 | B2 * | 7/2015 | Laub | H01R 12/727 |
| 9,136,634 | B2 * | 9/2015 | De Geest | H01R 12/724 |
| 9,246,251 | B2 * | 1/2016 | Regnier | H01R 12/71 |
| 9,331,407 | B2 | 5/2016 | Laurx et al. | |
| 9,548,570 | B2 | 1/2017 | Laurx et al. | |
| 9,553,381 | B2 * | 1/2017 | Regnier | H01R 13/6473 |
| 9,559,465 | B2 * | 1/2017 | Phillips | H01R 13/6471 |
| 9,742,088 | B1 * | 8/2017 | Pickel | H01R 13/03 |
| 9,991,642 | B1 * | 6/2018 | Ljubijankic | H01R 13/24 |
| 9,997,868 | B1 * | 6/2018 | Smith, Jr. | H01R 13/6477 |
| 10,243,307 | B2 * | 3/2019 | Ljubijankic | H01R 12/716 |
| 10,276,984 | B2 * | 4/2019 | Trout | H01R 13/6587 |
| 2010/0144168 | A1 * | 6/2010 | Glover | H01R 12/585 439/68 |
| 2011/0212632 | A1 | 9/2011 | Stokoe et al. | |
| 2012/0264334 | A1 * | 10/2012 | Laurx | H01R 13/6471 439/628 |
| 2013/0288521 | A1 * | 10/2013 | McClellan | H01R 13/6587 439/607.01 |
| 2013/0309910 | A1 | 11/2013 | Gulla | |
| 2014/0057493 | A1 * | 2/2014 | De Geest | H01R 13/6585 439/607.35 |
| 2016/0104990 | A1 | 4/2016 | Laurx et al. | |

FOREIGN PATENT DOCUMENTS

| | | | |
|---|---|---|---|
| CN | 103384042 | A | 11/2013 |
| CN | 204304028 | U | 4/2015 |
| CN | 105390887 | A | 3/2016 |
| JP | S60-151921 | A | 8/1985 |
| JP | H10-72665 | A | 3/1998 |
| JP | 2001-226767 | A | 8/2001 |
| KR | 20150056854 | A | 5/2015 |
| WO | 2017/218919 | A1 | 12/2017 |

OTHER PUBLICATIONS

Office action received for JP patent application No. 2018-553900, dated Oct. 29, 2019, 13 pages. (6 pages of English translation and 7 pages of official copy).

International Search Report and Written Opinion received for PCT application No. PCT/US2017/037918, dated Aug. 30, 2017, 11 pages.

International Preliminary Report on Patentability received for PCT Application No. PCT/US2017/037918, dated Dec. 27, 2018, 8 pages.

Decision of refusal received for JP application No. 2018-553900, dated Sep. 1, 2020, 10 pages. (5 pages of English translation and 5 pages of official copy).

* cited by examiner

SELECTIVELY SHIELDED CONNECTOR CHANNEL

RELATED APPLICATIONS

This application is a national stage of International Application No. PCT/US2017/037918, filed Jun. 16, 2017, which claims priority to U.S. Provisional Application No. 62/363,635, filed Jun. 18, 2016, both of which are incorporated herein by reference in their entirety.

TECHNICAL FIELD

This disclosure relates to the field of connectors, more specifically to shielded connectors suitable for use in high data rate applications.

DESCRIPTION OF RELATED ART

High data rate capable connectors, such as backplane connectors, are known. One feature of state of the art connectors is the ability to support 25-40 Gbps data rates using non return to zero (NRZ) encoding. While current connector designs are suitable to support such data rates, plans exist to implement 50 Gbps and 100 Gbps channels. Such data rates can be considered high speed signaling.

One issue with implementing a 50 Gbps or 100 Gbps channel is that the signaling frequency is like going to extend to about or above 25 GHz (50 Gbps is expected to be satisfied with NRZ encoding while 100 Gbps data rates will likely require level four pulse amplitude modulation (PAM4)). In either case, however, the Nyquist frequency will be in the range of about 25-28 GHz. Using such frequencies create substantial issues with signal integrity and existing methods will often be insufficient. For example, even a connector that works well for 40 Gbps data rates and may be able to support 50 Gbps for certain applications using NRZ encoding may be insufficient to support 100 Gbps data rates as the variations in amplitude level will be small and difficult to detect, thus requiring particularly clean channels. As a result, certain individuals would appreciate a backplane connector that can provide further signal integrity improvements, particularly at higher frequencies.

SUMMARY

A connector is disclosed that supports a plurality of wafers. Each of the wafers includes an insulative frame that supports pairs of terminals that are configured to differentially coupled. Each wafer can include a first shield that includes a plurality of channels, each channel partially enclosing a respective pair of differentially coupled signal terminals, wherein the shield is configured so that one channel is commoned to an adjacent channel. The wafer can further include an isolation shield that is provided adjacent the shield and is intended to be between the shield and an adjacent wafer (if such a wafer is present). In an embodiment the connector includes at least three differential pairs, a first pair for transmitting signals, a second pair for receiving signals and a third pair positioned the first and second pair. A conductive insert can be mounted over the third pair to help provide additional shielding between the first and second pair. The conductive insert is at least partially conductive and is electrically connected to at least one of the shield and the isolation shield.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
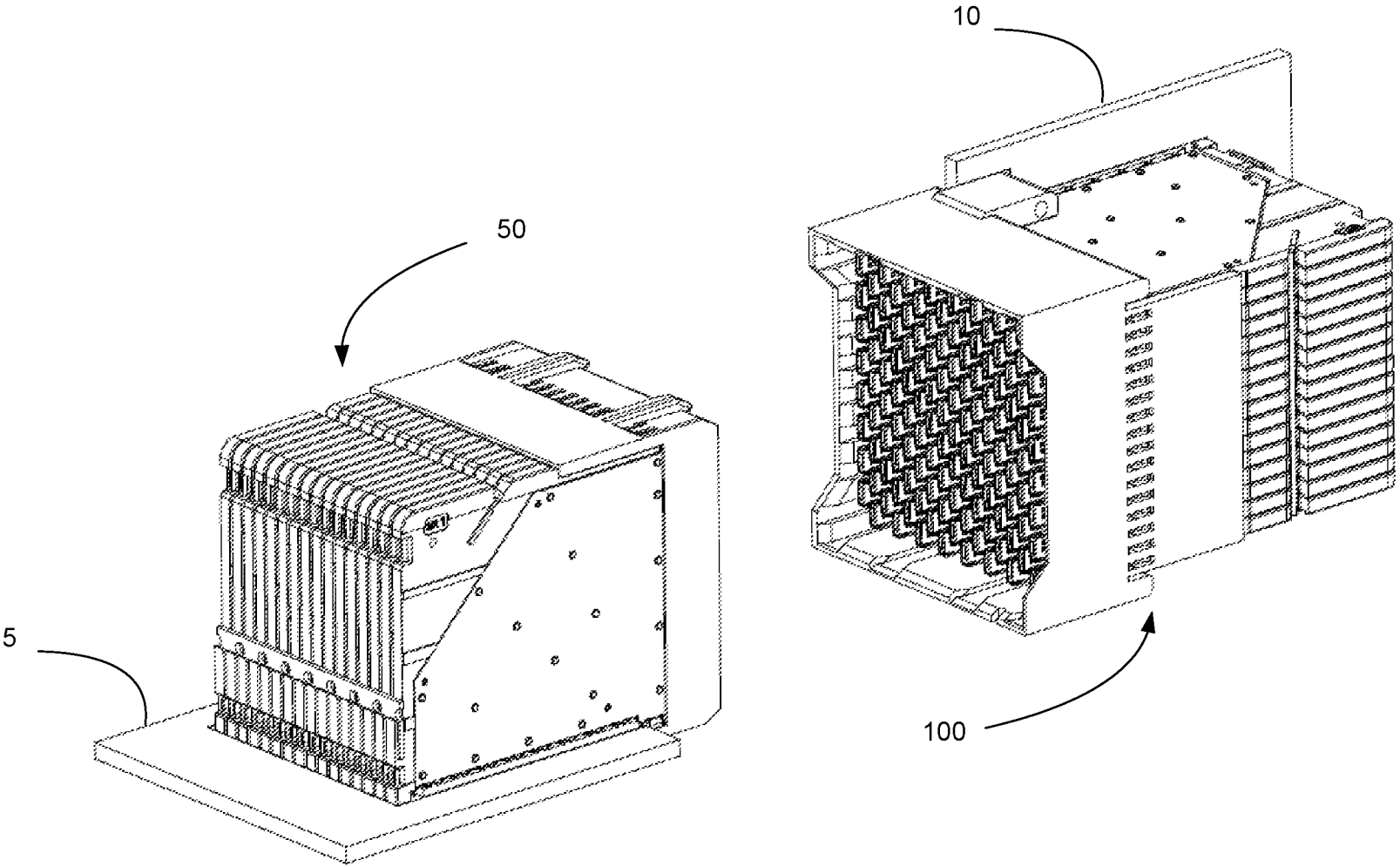
FIG. 1 illustrates a perspective view of an embodiment of a connector system configured to support high data rates.
Figure 2:
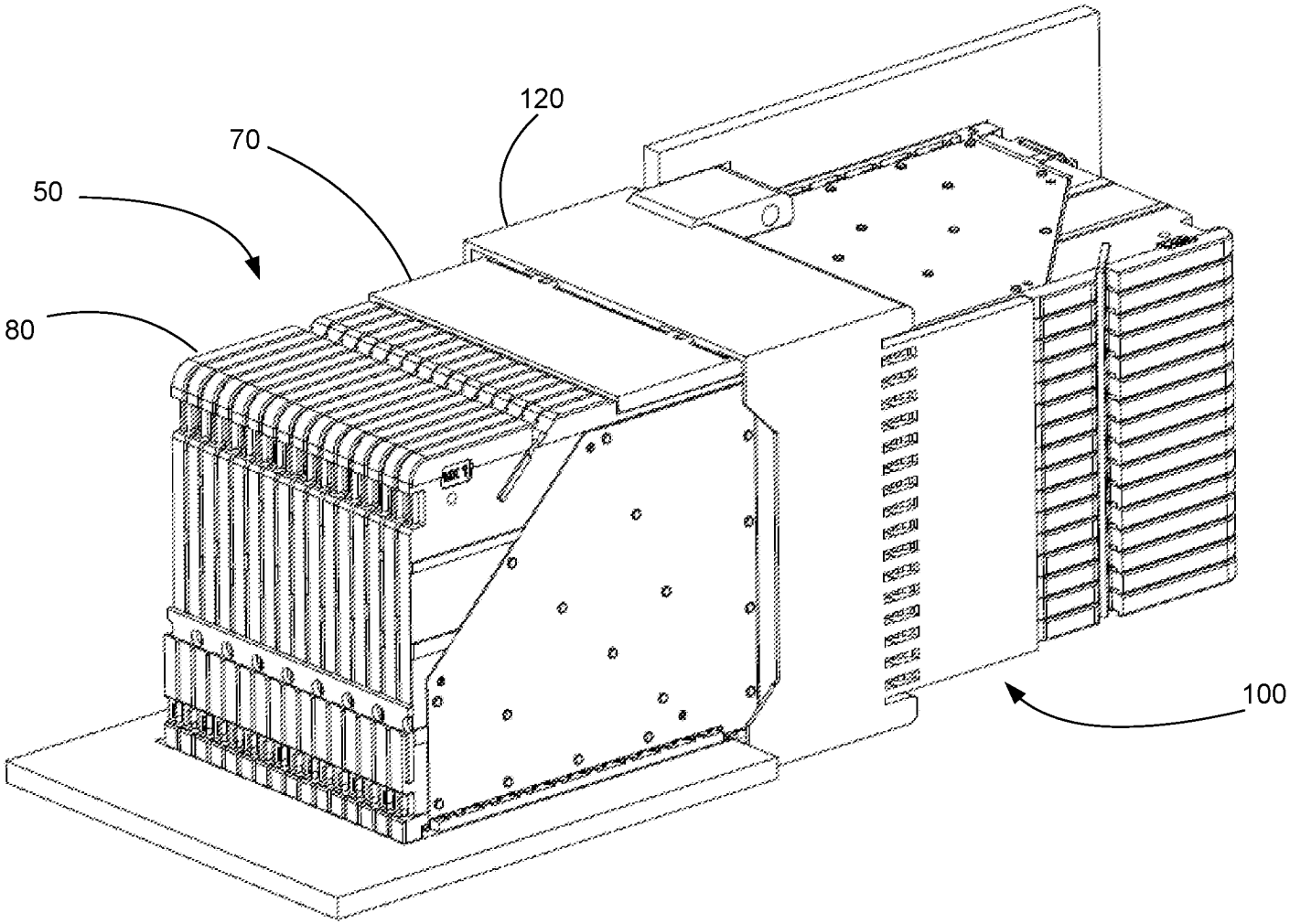
FIG. 2 illustrates a perspective view of the embodiment depicted in FIG. 1 with the connectors mated together.
Figure 3:
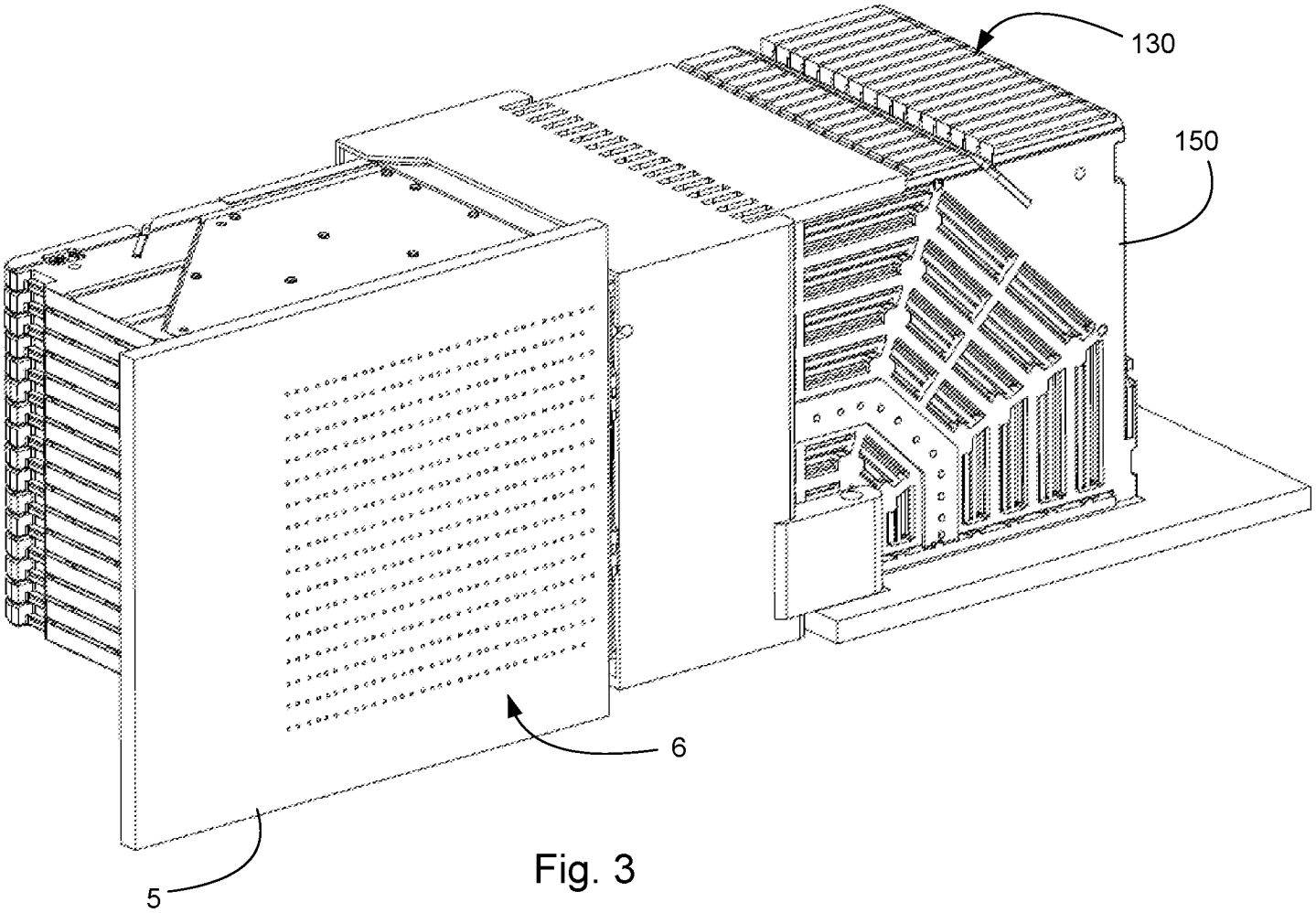
FIG. 3 illustrates another perspective view of the embodiment depicted in FIG. 2.

As can be appreciated from FIGS. 1-3, the depicted connector design is an orthogonal direct connection configuration. This means that two right angle connectors 50, 100 are mounted on circuit boards 5, 10, respectively, and the circuit boards 5, 10 (which each have a via pattern 6 that is configured to receive tails from the connectors 50, 100) are arranged so that they are orthogonal to each other. This configuration results in a situation where a column of pairs of signals terminals provided by a single wafer in connector 50 are split amongst a number of different wafers in connector 100.

As depicted, the connector 50 includes a wafer set 80 that includes three or more wafers and housing 70 that supports and helps provide an engagement interface with a mating connector. Similarly connector 100 includes a housing 120 that helps support and provide an engagement interface for wafer set 130. Naturally the housing 70 and/or the housing 120 could be omitted or provided with a substantially different shape if desired. As can be appreciated, in general the mechanical benefits of the housings make the use of housings desirable in many applications.

To support higher data rates such as 50 Gbps using NRZ, encoding, one approach Applicants have been found successful is to have the connector 50 be configured so that that one or more wafers (preferably three or four wafers) on a first side are used to transmit signals and one or more wafers (again preferably three or four wafers) on a second side, opposite the first side, are used to receive signals. One or two wafers that would normally be positioned between the transmit and receive wafers can be either be omitted or can be used to provide low data rate capable signals. If connector 50 is so configured then connector 100 will be arranged so that each wafer has some number of pairs of terminals for receiving signals and some number of pairs of terminals for transmitting signals. Between the transmit and receive signal pairs there can either be a blank space or the signal terminals can be used for low speed signaling. More will be discussed about this below.

Figure 4:
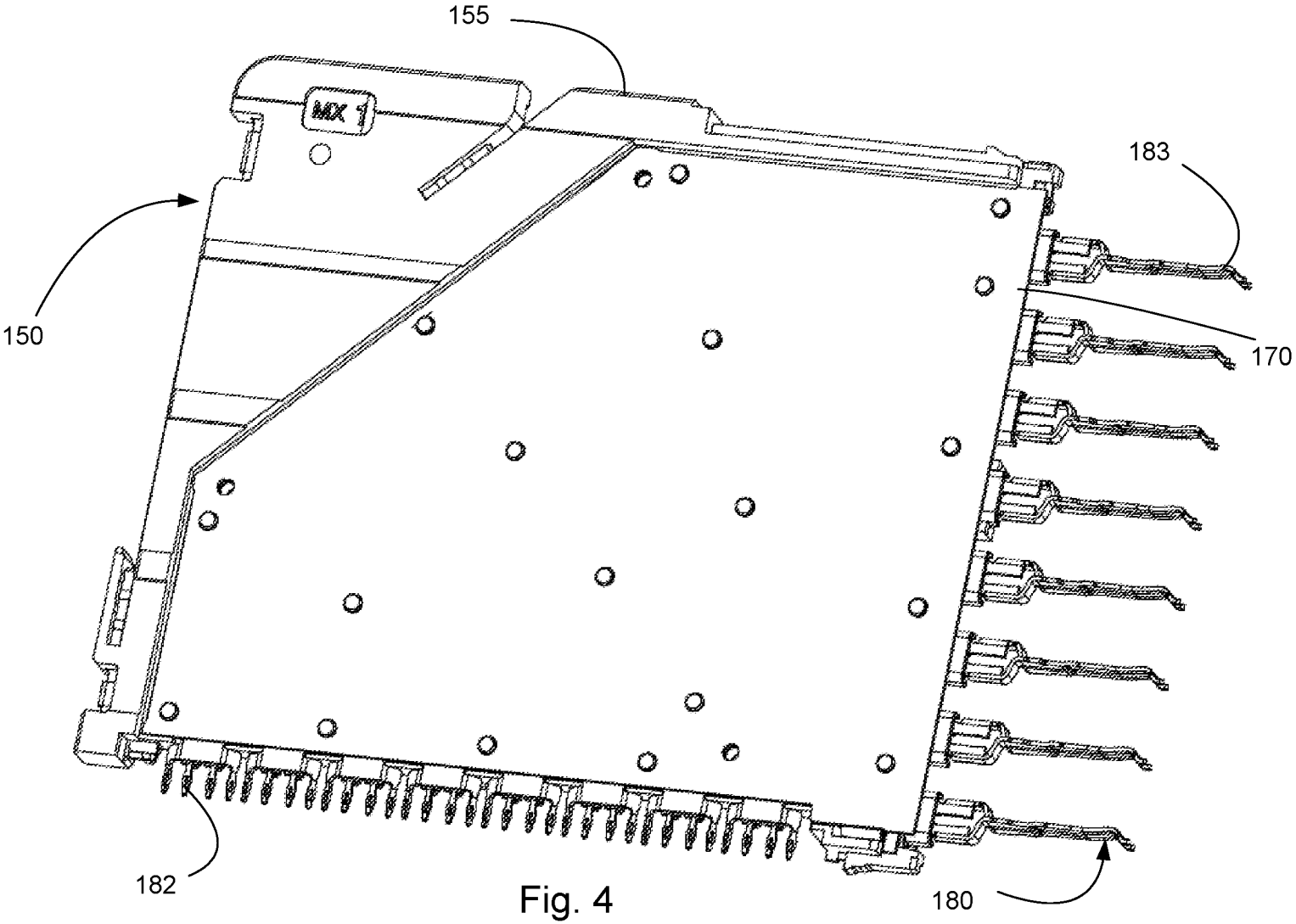
FIG. 4 illustrates a perspective view of an embodiment of a wafer.
Figure 5A:
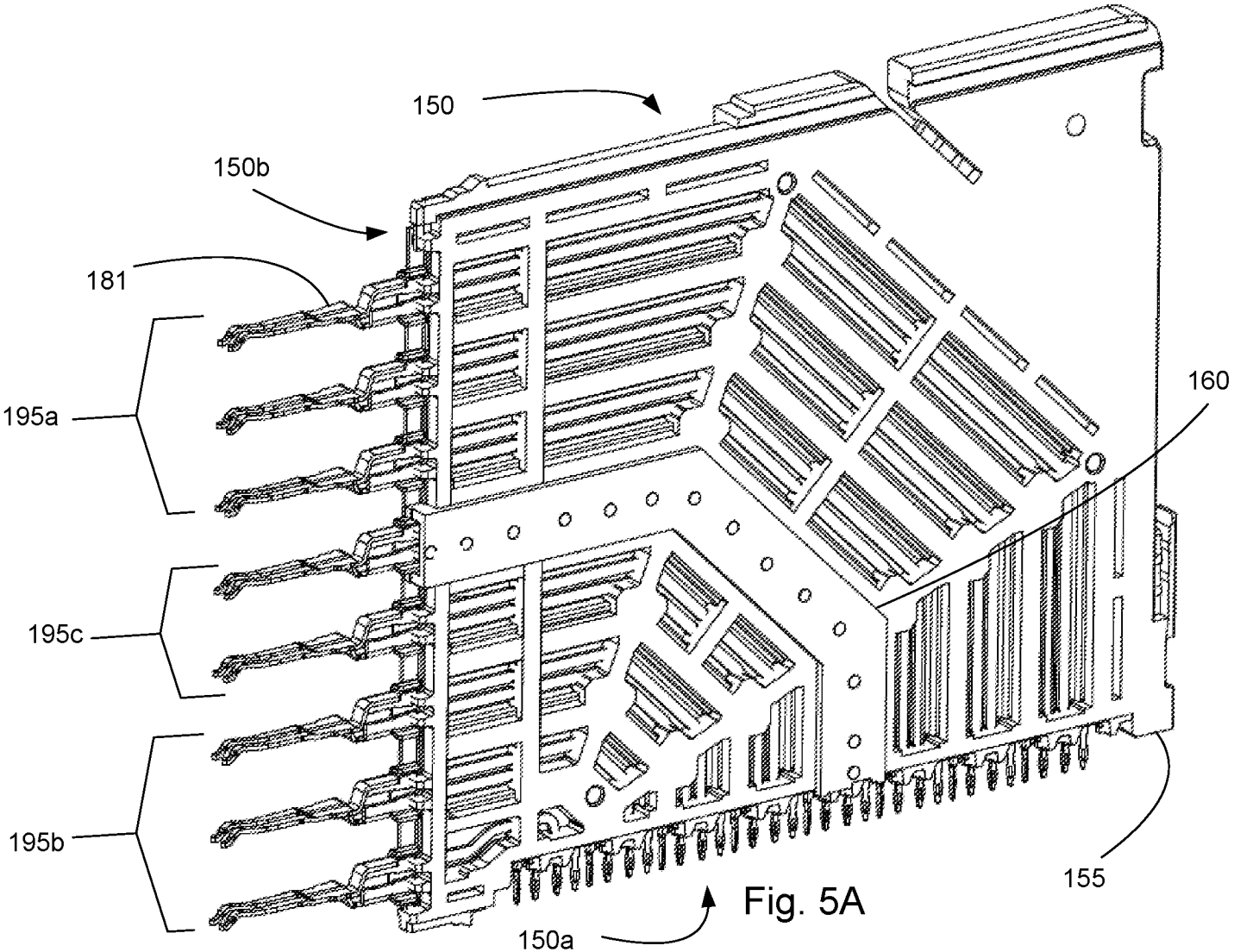
FIG. 5A illustrates another perspective view of the embodiment depicted in FIG. 4.
Figure 5B:
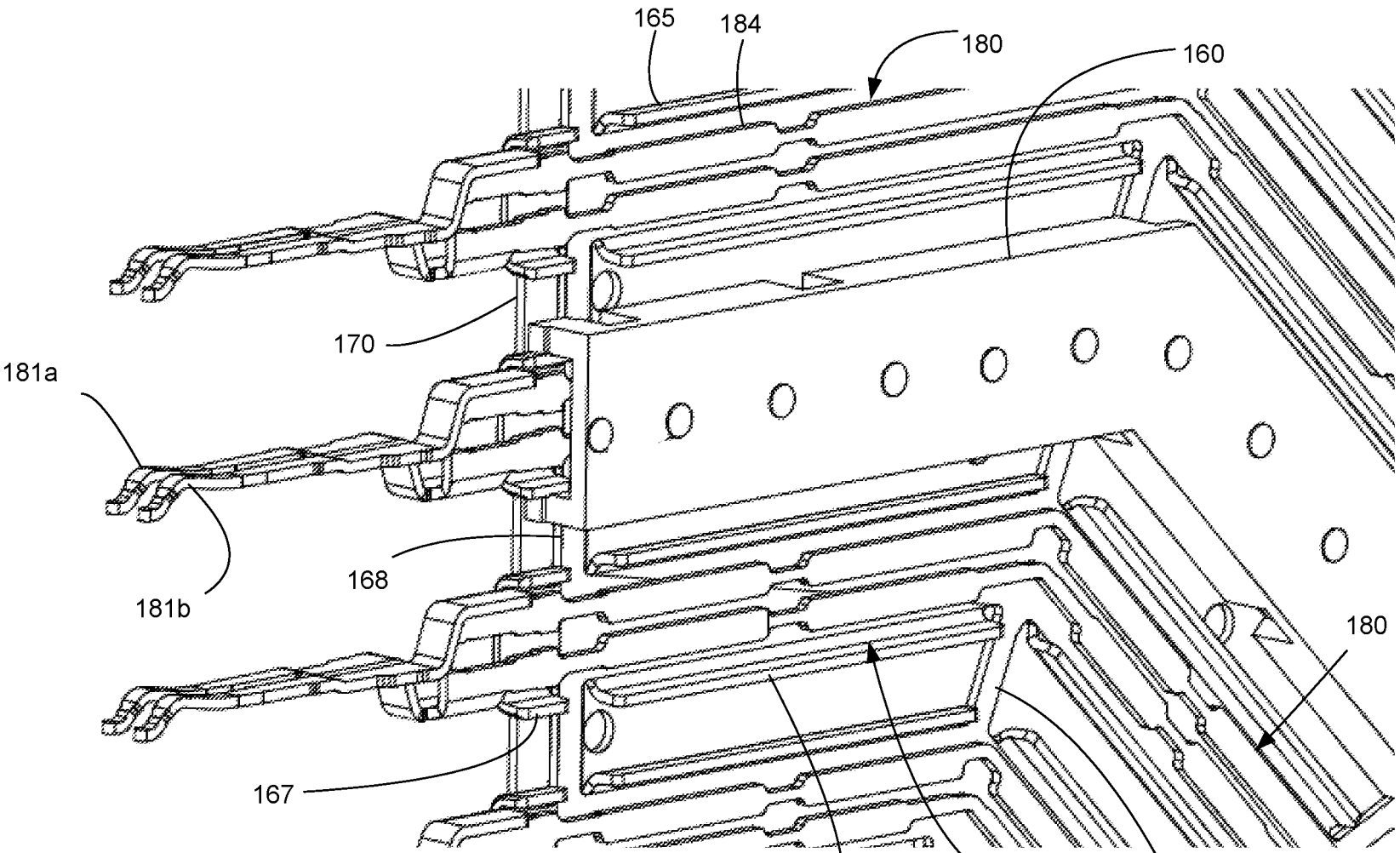
FIG. 5B illustrates an enlarged and simplified perspective view of the embodiment depicted in FIG. 5A.
Figure 6:
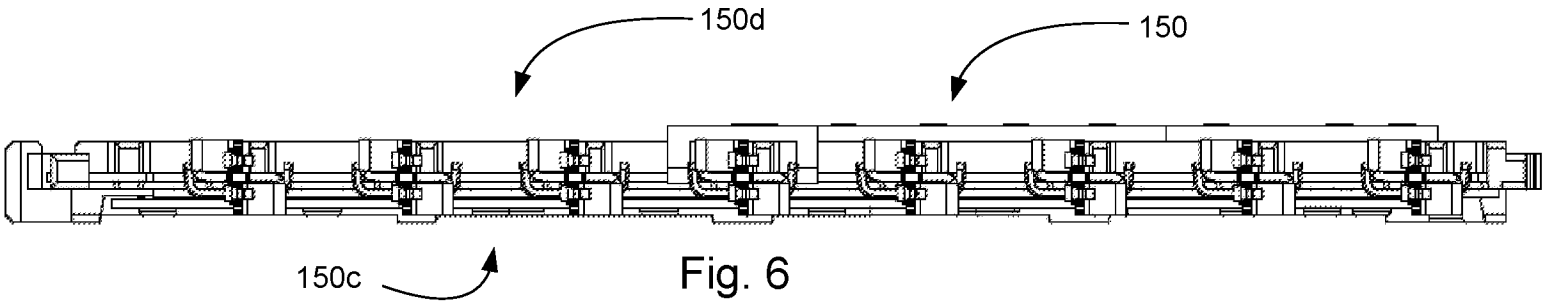
FIG. 6 illustrates a front view of an embodiment of a wafer.
Figure 7:
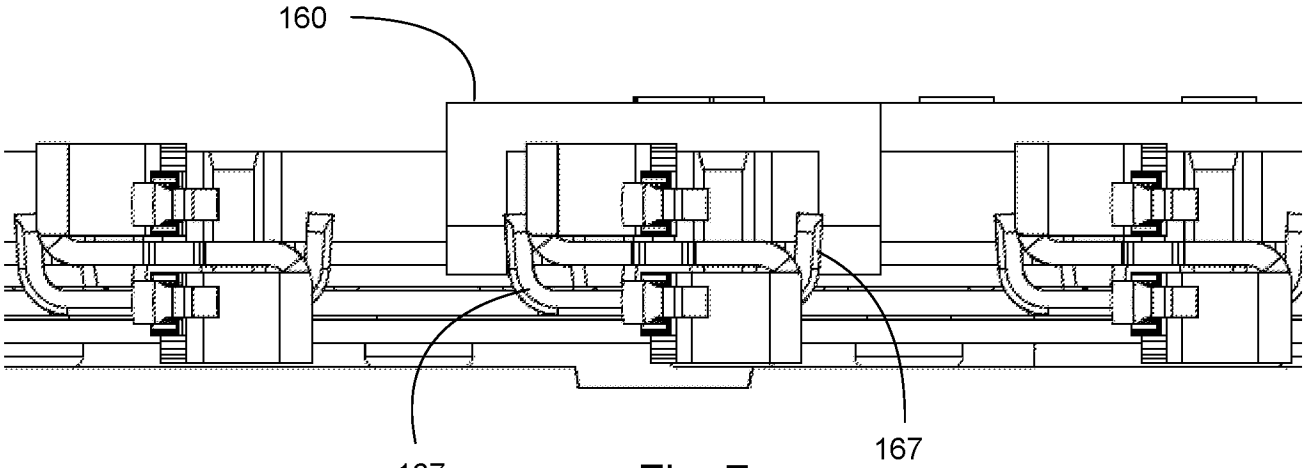
FIG. 7 illustrates an enlarged view of the embodiment depicted in FIG. 6.
Figure 8:
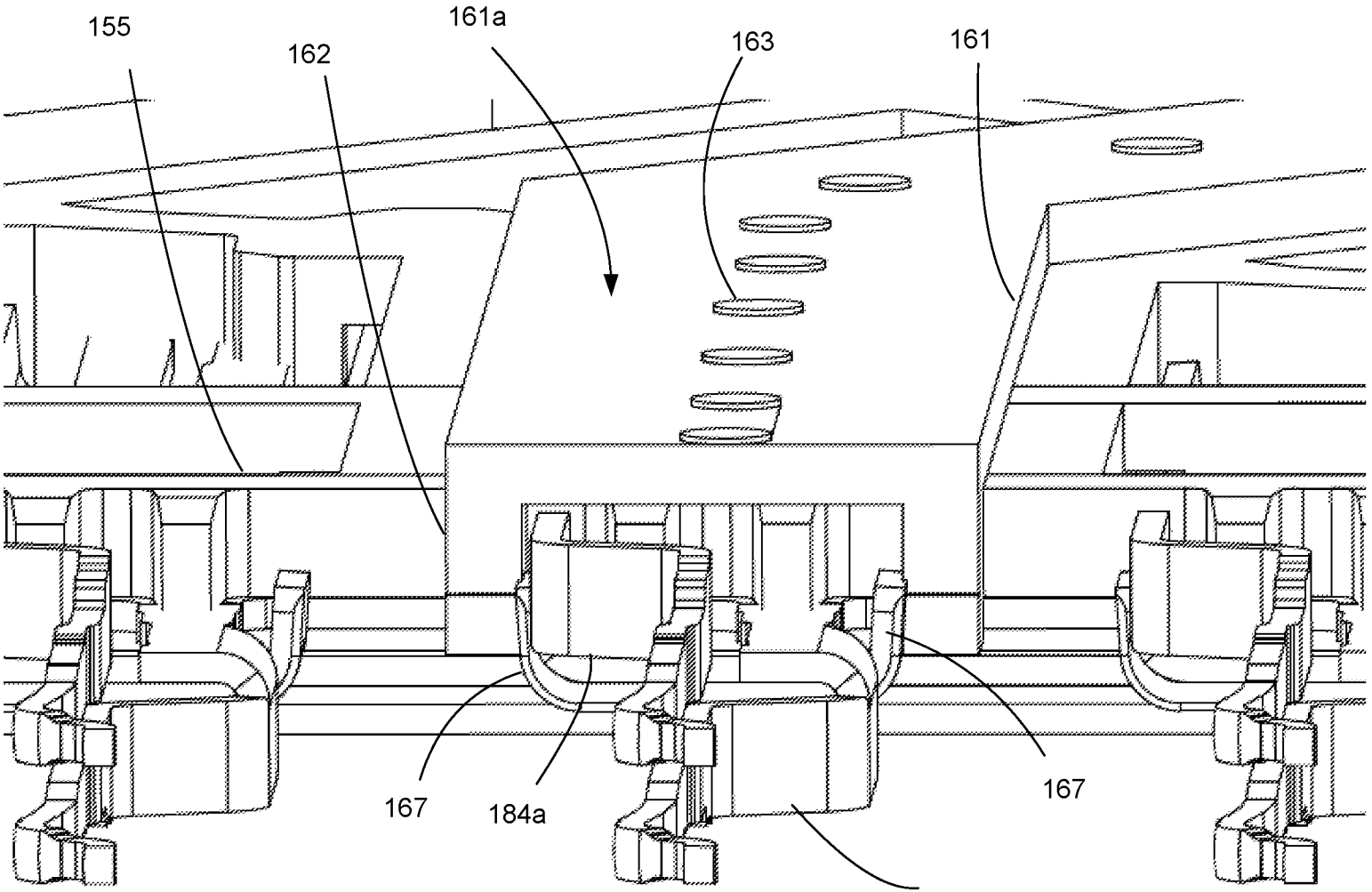
FIG. 8 illustrates a perspective view of the embodiment depicted in FIG. 7.
Figure 9:
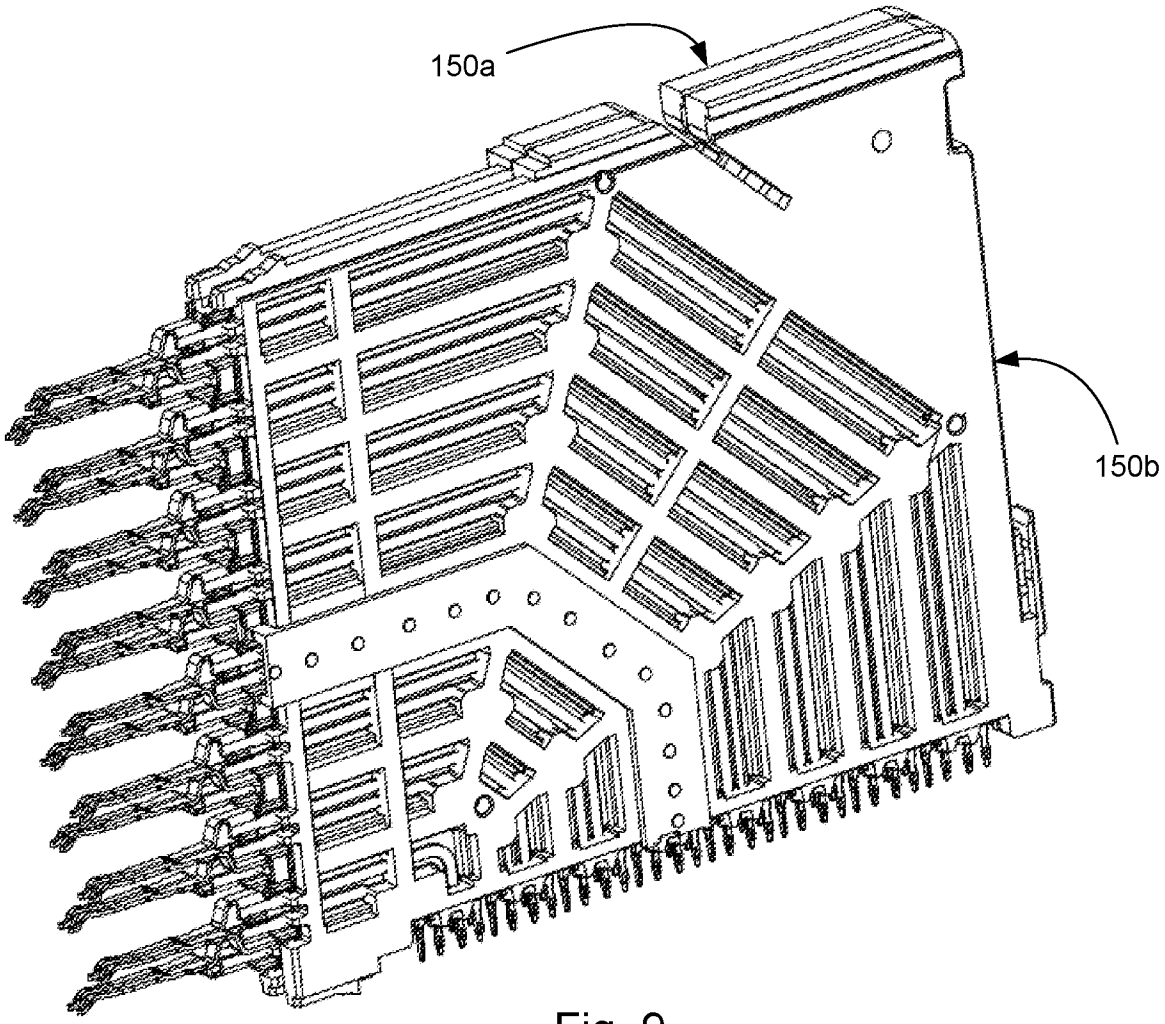
FIG. 9 illustrates a perspective view of an embodiment that includes two adjacent wafers.
Figure 10:
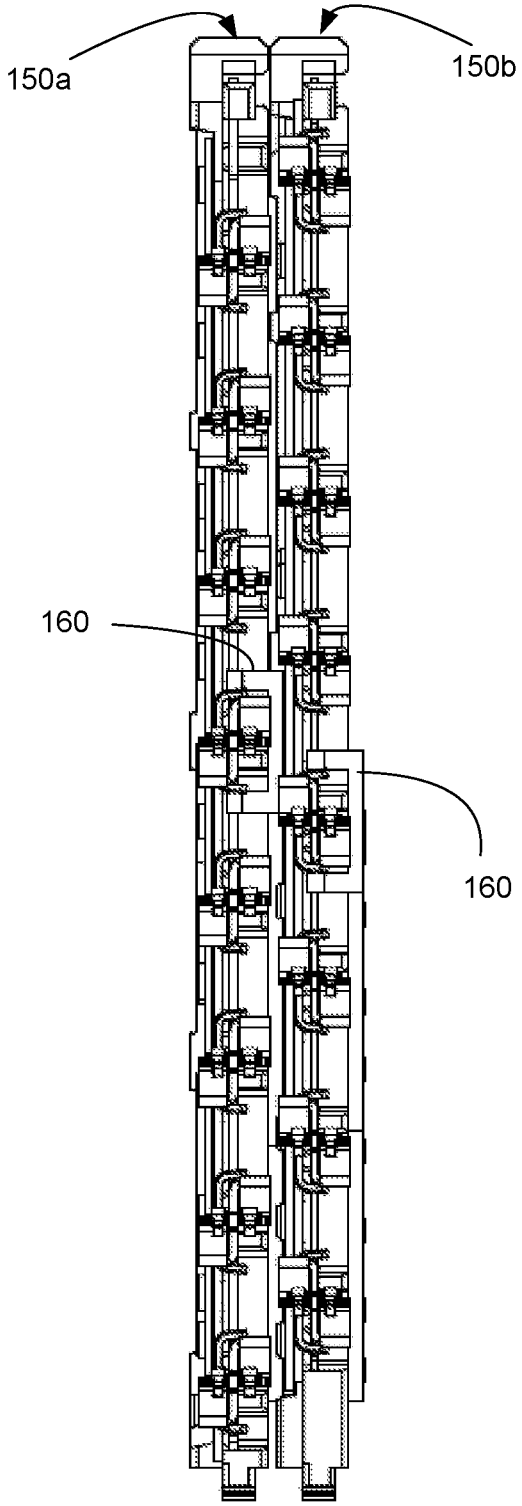
FIG. 10 illustrates a front perspective view of the embodiment depicted in FIG. 9.
Figure 11:
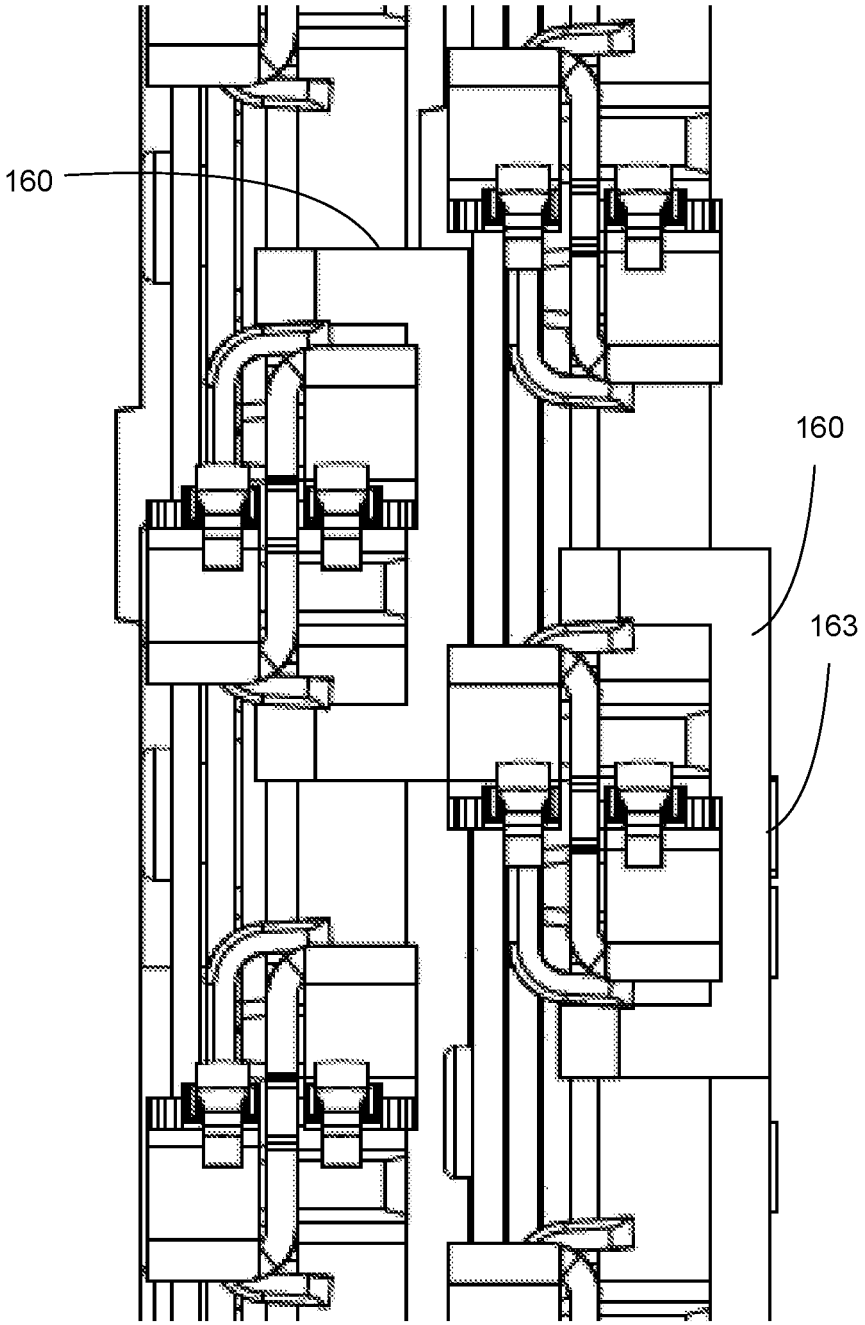
FIG. 11 illustrates an enlarged front view of the embodiment depicted in FIG. 10.
Figure 12:
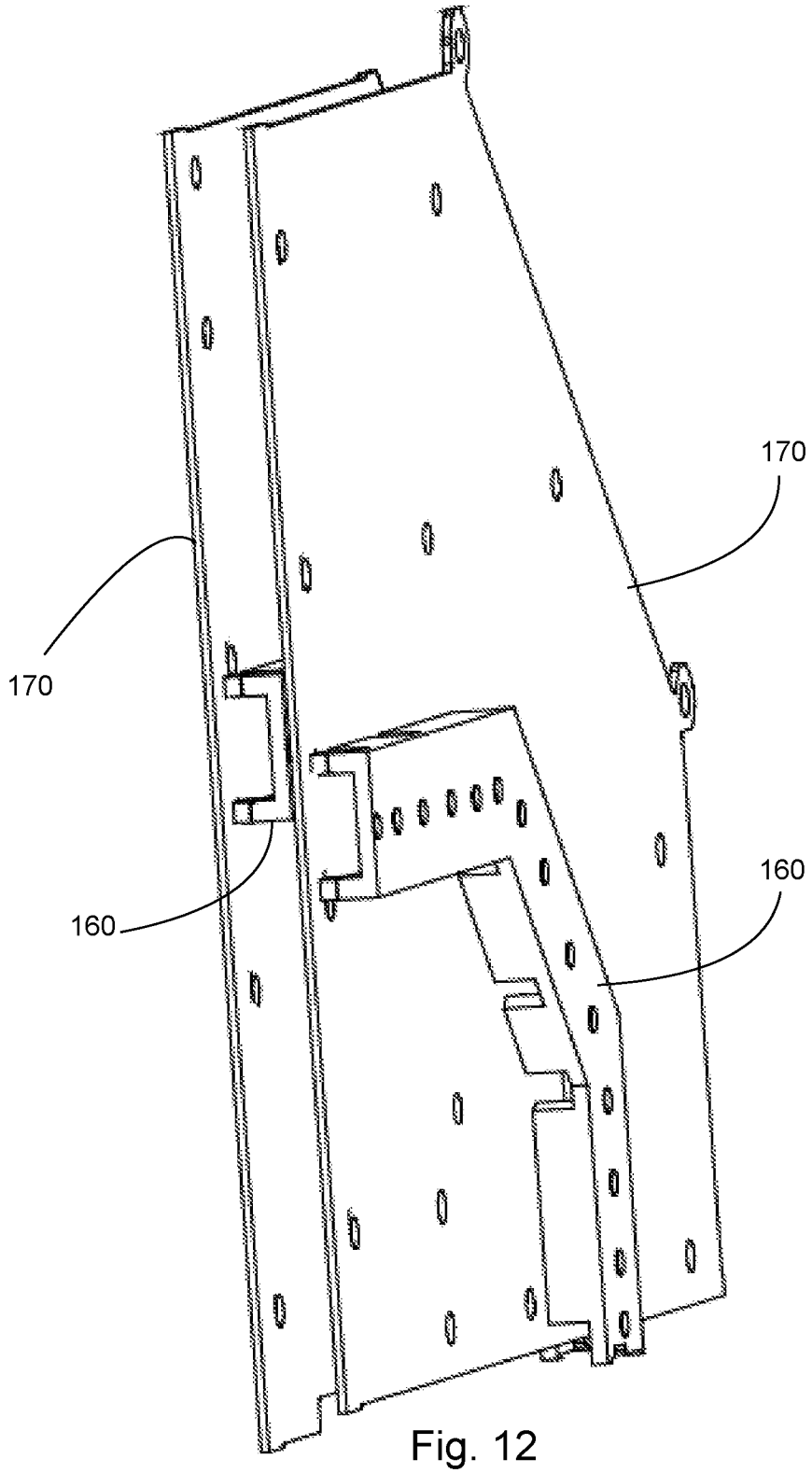
FIG. 12 illustrates a perspective simplified view of an embodiment of two adjacent wafers with the frame and terminals omitted for purposes of illustration.
Figure 13:
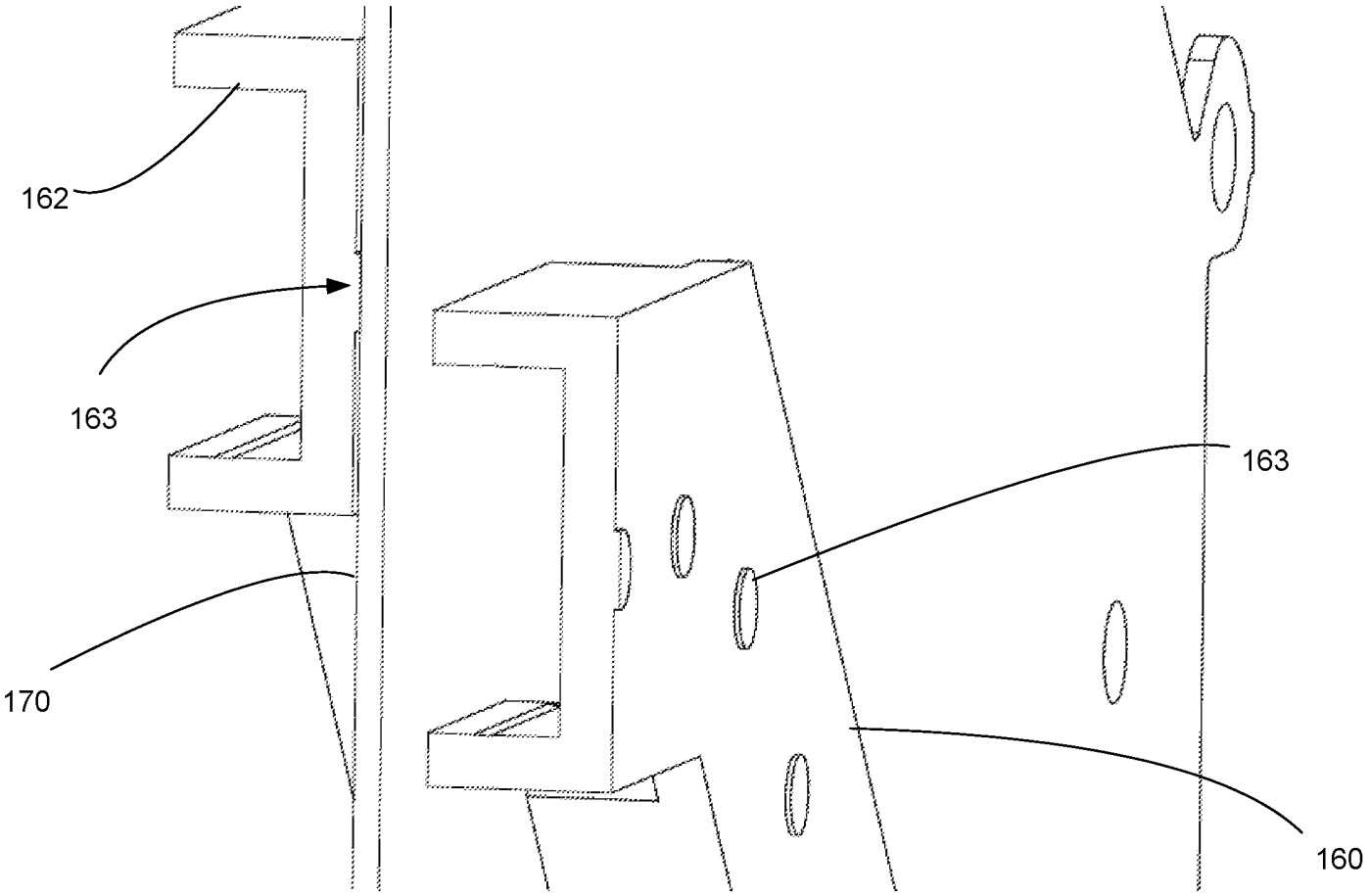
FIG. 13 illustrates an enlarged simplified perspective view of the embodiment depicted in FIG. 12.
Figure 14:
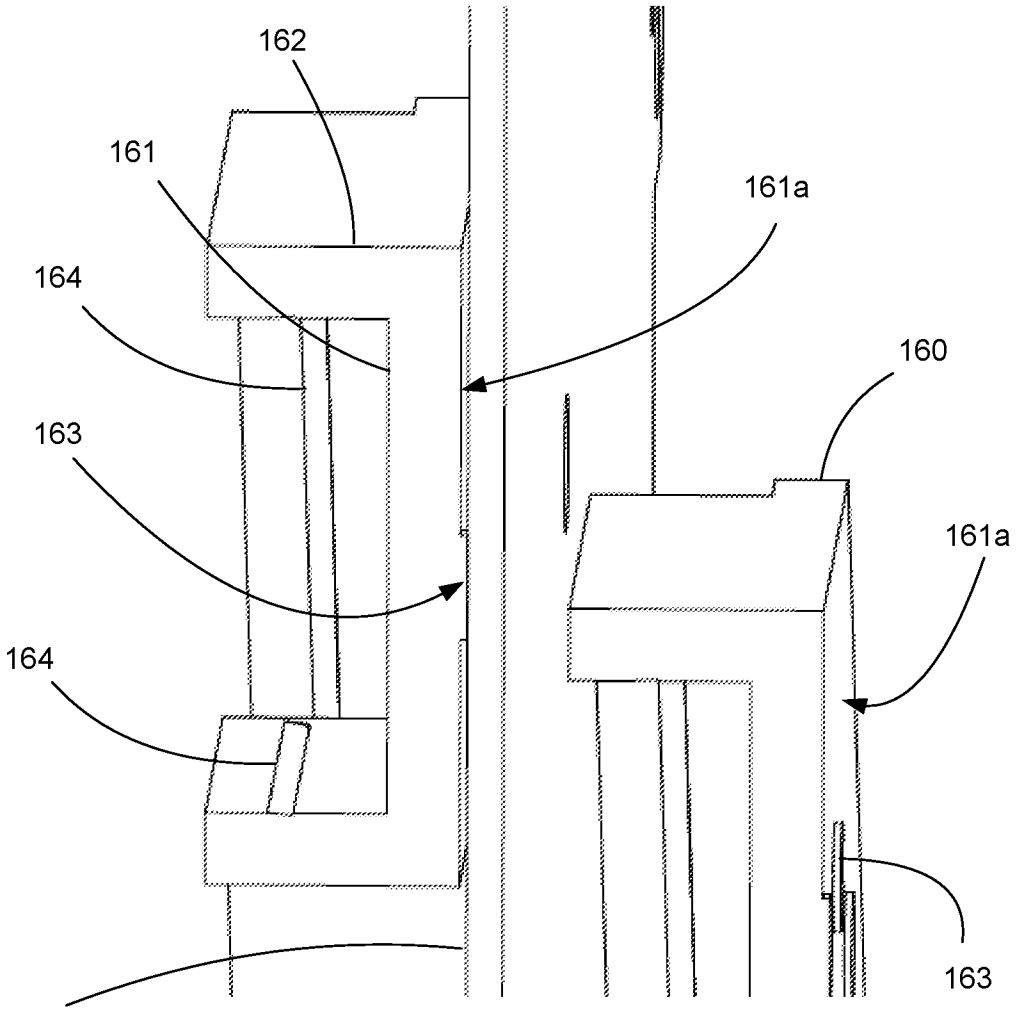
FIG. 14 illustrates another perspective view of the embodiment depicted in FIG. 13.

Each of the wafer sets 80, 130 include a plurality of wafers 150. The wafer 150 depicted in FIGS. 4-5B includes a frame 155 formed of insulative material and is configured to provide 8 differential pairs 180 (but some other number ranging from 3-12 is reasonably feasible). Each differential pair 180 consists of two terminals 181 and each terminal 181 has a tail 182, a contact 183 and a body 184 that extends therebetween.

The wafer 150 has a first edge 150*a* and a second edge 150*b* and further includes a shield 165 that forms a plurality of channels 166 formed by shoulders 167. The shield 165 does not include any contacts but it is expected that the shield on the mating connector would include contacts that would engage the shield 165. The channels 166 are aligned with the differential pairs 180 and can extend from the first edge 150*a* to the second edge 150*b*. The channels 166 to help provide the equivalent of a ground terminal and shielding without the need for a separate ground terminal. This allows the differential pairs 180 to be positioned closer together while still providing desirable signal integrity performance. The shield 165 is coupled to the isolation shield to provide additional isolation between wafers and the channels 166 are connected to each other via cross bar 168.

The terminal pairs 180 can be arranged in top region 195*a*, a bottom region 195*b* and a central 195*c*. The top region 195*a* can be used to transmit high-speed signals with the bottom region 195*b* can be used to receive high-speed signals. Conversely, the top region 195*a* can be used to receive high-speed signals while the bottom region can be used to transmit high-speed signals. In either case, the central region can be used for low speed signal.

As can be appreciated from FIGS. 5A-14, a conductive insert 160 can be used to enhance the shielding between differential pairs 180 in the top region 195*a* and differential pairs 180 in the bottom region 195*b*. While the depicted embodiment has three differential pairs some other number of differential pairs could be used. In an embodiment, the conductive insert 160 can be positioned around a differential pair that are configured for use at providing signals at a low data rate. The conductive insert 160 has a top wall 161 and side walls 162 that can be configured to be electrically connected to the shield 165 (for example, by engaging the shoulders 167 with ridge 164) and/or the isolation shield 170 on the supporting wafer and can be electronically connected to an isolation shield 170 on an adjacent wafer 150 by having a slight interference first between the conductive insert 160 and the corresponding isolation shield 170. The conductive insert 160 may include projections 163 on an outer surface 161*a* of the tope wall 161 that press against and engage the adjacent isolation shield 170.

Figure 15:
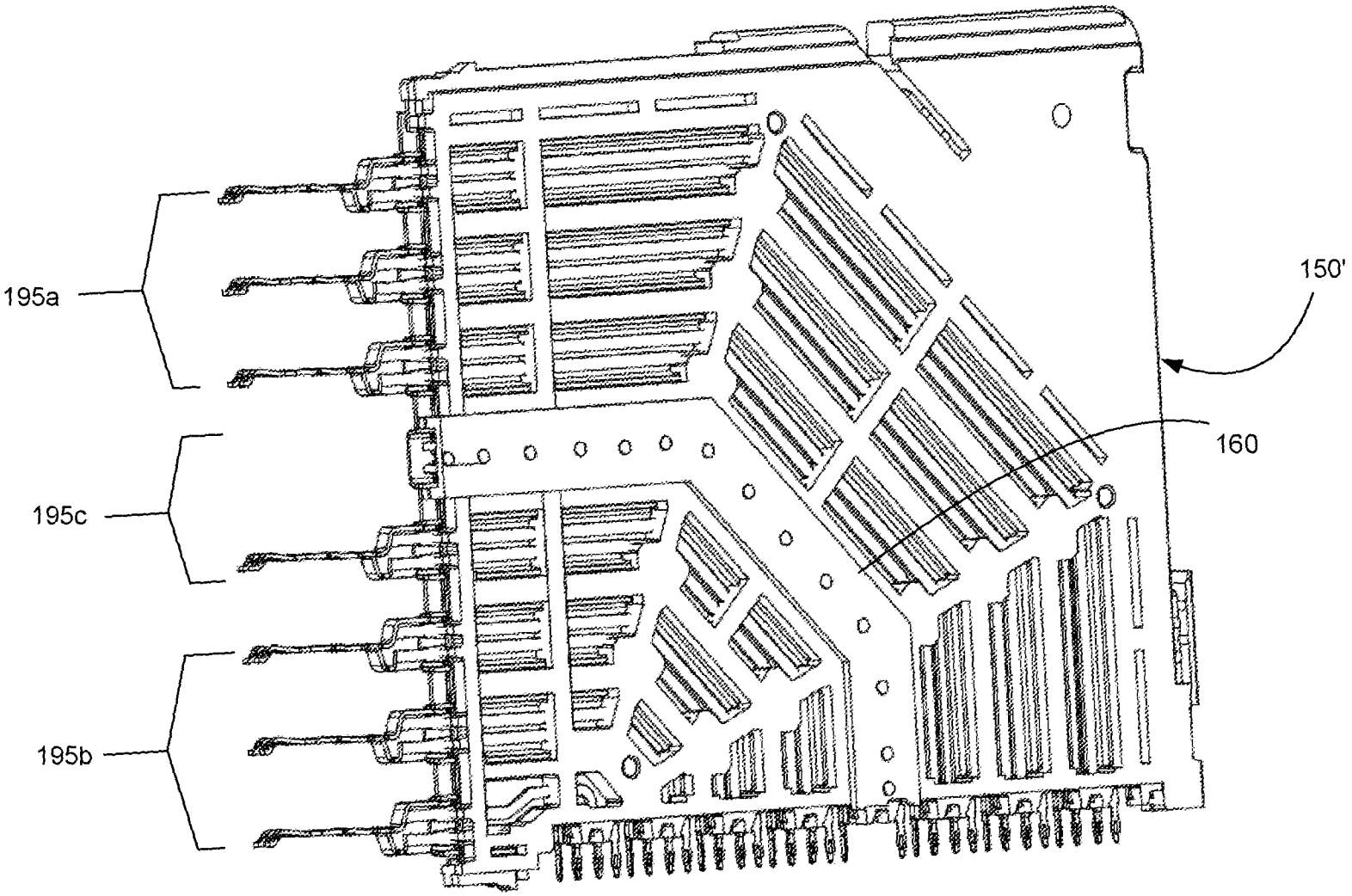
FIG. 15 illustrates a perspective view of another embodiment of a wafer.

As shown in FIG. 15, a wafer 150' can be configured so that a pair or more of the signal terminals in the central region 195*c* can be omitted. In many circumstances it is beneficial to have the signal terminals in the central region 195*c* to support transmission of lower speed signals. However, in circumstances where the low speed signal terminals are not needed the conductive insert 160 can still offer increased shielding between the transmit and receive signal pairs as it provides a vertical isolation/barrier between transmit and receive channels within a wafer.

Figure 16:
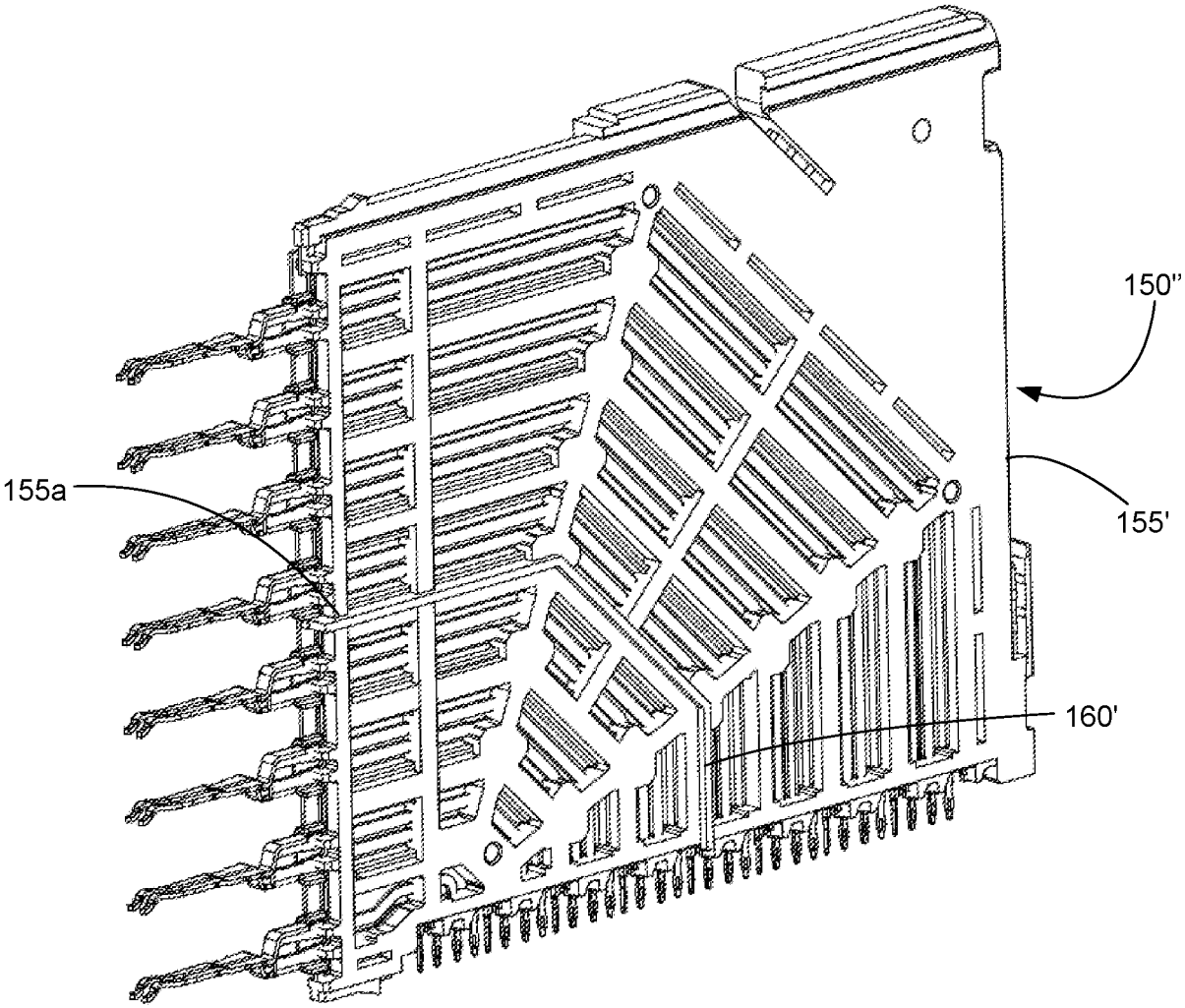
FIG. 16 illustrates a perspective view of another embodiment of a wafer.

As can be appreciated from FIG. 16, the conductive insert can also be formed as a wall. As depicted, the conductive insert 160' has a wall shape and can be positioned between a differential pair 180 that is configured to transmit signals and a differential pair 180 that is configured to receive signals. The conductive insert 160' can be pressed into a slot 155*a* in the frame 155' and can engage the isolation shield 170 and/or the shield 160 that supports the conductive insert 160' while engaging an isolation shield 170 of an adjacent wafer. One benefit of the conductive insert 160' is that the use of a single wall offers additional space for high speed signal pairs on the wafer 150. It is expected that such a configuration will not provide as much isolation between the transmit and receive pairs and thus far end cross talk may be slightly higher but the benefit is that all the pairs can be used for high speed signaling. Thus the design depicted in FIG. 16 offers flexibility in situations where the performance tradeoff versus size is suitable for the application.

Alternatively, the conductive insert could cover multiple differential pairs rather than being a wall or just covering one differential pair (as depicted). Increasing the size of the conductive insert so that it covers multiple differential pairs (preferably with each pair being covered and isolated from an adjacent pair) is expected to provide additional shielding and thus may be desirable for applications that are especially sensitive to crosstalk. Naturally, with a larger conductive insert additional projections can be provided in multiple rows (it being understood that the rows of projections will not be linear but instead will follow the shape of the insert).

Figure 17:
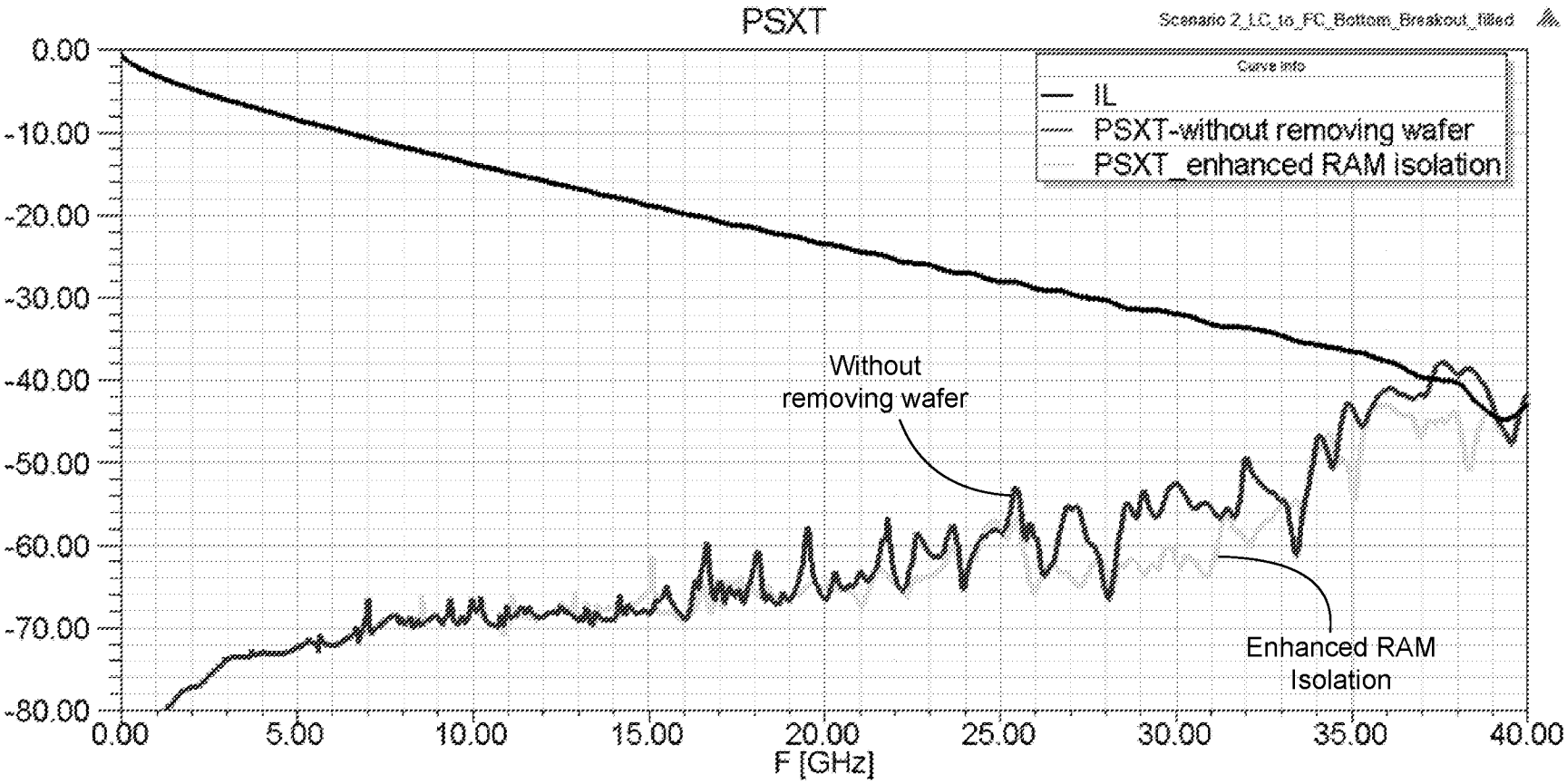
FIG. 17 illustrates a graphical depiction of cross talk versus insertion loss for an embodiment of a connector with and without a conductive insert.

As can be appreciated from FIG. 17, simulation testing shows some benefits between 20 and 25 GHz and a more significant benefit between 25 and 30 GHz for a system that includes a conductive insert versus a system that does not include a conductive insert. The benefit between 25-30 GHz is significant because the additional 3-5 dB of signal between the crosstalk noise level and the insertion loss can be sufficient to support PAM4 signaling at 25-28 GHz, taking a connector suitable for 50-56 Gbps using NRZ encoding to a connector suitable for 100-112 Gbps using PAM4 encoding. In other words, for a configuration where the signaling has a Nyquist frequency of about 28 GHz the benefit of the conductive insert can be significant.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing, a first wafer supported by the housing and having a first insulative frame and a first side and a second side and a first edge and a second edge, the first side having a first shield mounted thereon, the first shield having a plurality of channels extending from the first edge to the second edge, the first insulative frame supporting a plurality of pairs of signal terminals aligned in the plurality of channels, the first wafer having a first isolation shield mounted on the first side that is electrically connected to the first shield;

a second wafer supported by the housing and having a second insulative frame and a third side and a fourth side and a first edge and a second edge, the third side facing the second side of the first wafer and having a second shield mounted thereon, the second shield having a plurality of channels extending from the first edge to the second edge, the second insulative frame supporting a plurality of pairs of signal terminals aligned in the plurality of channels, the second wafer having a second isolation shield mounted on the third side that is electrically connected to the second shield; and a single conductive insert mounted on the second side of the first wafer, the conductive insert extending between the first and second edge and being aligned with one of the plurality of channels and engaging the second isolation shield.

2. The connector of claim 1, wherein the conductive insert has two side walls and a top wall and forms a U-shaped channel over one of the signal terminal pairs.

3. The connector of claim 2, wherein the top wall has a plurality of projections that are configured to engage the second isolation shield.

4. The connector of claim 1, wherein the first wafer has a top region with at least one signal pair, a bottom region with at least one signal pair and a central region positioned between the top and bottom regions, the central region having at least one signal pair, wherein the conductive insert is mounted in the central region.

5. The connector of claim 4, wherein the channel aligned with the conductive insert does not include a terminal pair.

6. A connector, comprising:

a housing;

a first wafer supported by the housing, the first wafer having a first insulative frame and a first side and a second side and a first edge and a second edge, the first side having a first shield mounted thereon, the first shield having three channels extending from the first edge to the second edge, the first insulative frame supporting three pairs of signal terminals, each of the pairs of signal terminals arranged in one of the three channels, wherein the pairs of signal terminals and the channels are arranged in one of a top region, a bottom region and a central region, the central region being between the top and bottom region, the first wafer having a first isolation shield mounted on the first side that is electrically connected to the first shield;

a second wafer supported by the housing, the second wafer having a second insulative frame and a third side and a fourth side and a first edge and a second edge, the third side facing the second side of the first wafer and having a second shield mounted thereon, the second shield having a plurality of channels extending from the first edge to the second edge, the second insulative frame supporting a plurality of pairs of signal terminals aligned in the plurality of channels, the second wafer having a second isolation shield mounted on the third side that is electrically connected to the second shield; and a single conductive insert mounted on the second side of the first wafer in, the conductive insert extending between the first and second edge and being aligned with the channel in the central region.

7. The connector of claim 6, wherein the first shield has at least five channels and at least two channels of the at least five channels are in the top region and at least two channels of the at least five channels are in the bottom region.

8. The connector of claim 7, wherein the first shield has more channels then there are pairs of signal terminals.

9. The connector of claim 8, wherein the conductive insert is aligned with a channel that does not include a pair of signal terminal aligned therewith.

* * * * *